US011114268B2

(12) United States Patent
Tsujino

(10) Patent No.: US 11,114,268 B2
(45) Date of Patent: Sep. 7, 2021

(54) X-RAY GENERATING TUBE, X-RAY GENERATING APPARATUS, AND RADIOGRAPHY SYSTEM

(71) Applicant: CANON KABUSHIKI KAISHA, Tokyo (JP)

(72) Inventor: Kazuya Tsujino, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 371 days.

(21) Appl. No.: 16/073,290

(22) PCT Filed: Dec. 28, 2016

(86) PCT No.: PCT/JP2016/005252
§ 371 (c)(1),
(2) Date: Jul. 26, 2018

(87) PCT Pub. No.: WO2017/130262
PCT Pub. Date: Aug. 3, 2017

(65) Prior Publication Data

US 2019/0035593 A1 Jan. 31, 2019

(30) Foreign Application Priority Data

Jan. 29, 2016 (JP) ..... JP2016-016375

(51) Int. Cl.
*H01J 35/00* (2006.01)
*H01J 35/04* (2006.01)
(Continued)

(52) U.S. Cl.
CPC ..... *H01J 35/045* (2013.01); *H01J 35/065* (2013.01); *H01J 35/08* (2013.01); *H01J 35/116* (2019.05);
(Continued)

(58) Field of Classification Search
CPC ..... H01J 35/14; H01J 35/045; H01J 35/08; H01J 35/186; H01J 2235/168; H05G 1/085; H05G 1/32
See application file for complete search history.

(56) References Cited

U.S. PATENT DOCUMENTS 4,621,213 A 11/1986 Rand
4,879,518 A 11/1989 Broadhurst
(Continued)

FOREIGN PATENT DOCUMENTS

JP S47-31054 U 12/1972
JP H01143198 A 6/1989
(Continued)

*Primary Examiner* — Dani Fox
(74) *Attorney, Agent, or Firm* — Canon U.S.A., Inc. IP Division

(57) ABSTRACT

The present disclosure provides a reliable X-ray generating tube that forms a focus with a stable size and shape. The X-ray generating tube includes an electron gun including an electron emitting portion, a plurality of grid electrodes, and an insulating support member that supports the plurality of grid electrodes. The electron gun includes a conductive section that hides the insulating support member to prevent the insulating support member from being directly viewed from an electron through path of electrons emitted from the electron emitting portion and passing through the grid electrodes.

24 Claims, 7 Drawing Sheets

(51) Int. Cl.

| | |
|---|---|
| ***H01J 35/14*** | (2006.01) |
| ***H01J 35/08*** | (2006.01) |
| ***H01J 35/06*** | (2006.01) |
| ***H05G 1/08*** | (2006.01) |
| ***H05G 1/32*** | (2006.01) |
| *H01J 35/18* | (2006.01) |

(52) U.S. Cl.

CPC ..... *H01J 35/14* (2013.01); *H01J 35/147* (2019.05); *H01J 35/153* (2019.05); *H05G 1/085* (2013.01); *H05G 1/32* (2013.01); *H01J 35/186* (2019.05); *H01J 2235/168* (2013.01)

(56) References Cited

U.S. PATENT DOCUMENTS

| | | | | |
|---|---|---|---|---|
| 2004/0090166 | A1 | 5/2004 | Sanders | |
| 2011/0114830 | A1* | 5/2011 | Reijonen ..... | H01J 35/16 250/251 |
| 2017/0199283 | A1* | 7/2017 | Hu ..... | G01V 5/12 |

FOREIGN PATENT DOCUMENTS

| | | | |
|---|---|---|---|
| JP | 2002-298772 | A | 10/2002 |
| JP | 2007-66694 | A | 3/2007 |
| JP | 2011134498 | A | 7/2011 |
| JP | 2015135722 | A | 7/2015 |
| SU | 1481870 | A1 | 5/1989 |

* cited by examiner

X-RAY GENERATING TUBE, X-RAY GENERATING APPARATUS, AND RADIOGRAPHY SYSTEM

CROSS-REFERENCE TO RELATED APPLICATIONS

This application is a national phase application of international application PCT/JP2016/005252, filed on Dec. 28, 2016, and claims the benefit of, and priority to, Japanese Patent Application No. 2016-016375, filed Jan. 29, 2016, which applications are hereby incorporated by reference herein in their entireties.

TECHNICAL FIELD

The present disclosure relates to an X-ray generating apparatus that can be used in nondestructive radiography and so on in the fields of medical equipment and industrial equipment and to a radiography system equipped with the X-ray generating apparatus.

BACKGROUND ART

As semiconductor devices have been increasingly miniaturized and increased in layer, recent inspection of electronic devices typified by semiconductor integrated circuit substrates in an industrial field uses an X-ray inspection apparatus equipped with an X-ray generating tube.

A known example of an electron source that emits an electron beam to a target is an X-ray generating tube equipped with an electron gun projected toward the target along a tube axis.

PTL 1 discloses a technique for achieving high positional accuracy of a focus formed on a target and microfocusing using an electron gun including a plurality of grid electrodes near the target.

The plurality of grid electrodes of the electron gun are configured to be individually supported by insulating members so that the distance between the electrodes is determined and to be subjected to predetermined voltages.

PTL 2 discloses an X-ray generating tube including an electron gun in which a plurality of grid electrodes are supported at certain intervals by an insulating support extending along a tube axis for microfocusing.

CITATION LIST

Patent Literature

PTL 1: Japanese Patent Laid-Open No. 2002-298772
PTL 2: Japanese Patent Laid-Open No. 2007-66694

SUMMARY OF INVENTION

Technical Problem

A radiography system that uses an X-ray generating tube equipped with an electron gun including a plurality of grid electrodes supported by an insulating member can form a low-quality image.

A study by the inventor revealed that fluctuations in focal position or focal shape due to the operation history of the X-ray generating tube are responsible for the decrease in image quality.

The present disclosure provides a reliable X-ray generating tube and a reliable X-ray generating apparatus equipped with an electron gun including grid electrodes supported by an insulating member in which fluctuations in focal position or shape are reduced. The present disclosure also provides a radiography system including an X-ray generating apparatus according to an embodiment of the present disclosure so that high-image-quality radiography is allowed.

Solution to Problem

An X-ray generating tube according to a first aspect of the present disclosure includes a target and an electron gun. The target is configured to generate X rays under electronic irradiation. The electron gun includes an electron emitting portion that emits electrons, a plurality of grid electrodes that form an electron beam to be emitted toward the target, and an insulating support member that electrically insulates and supports at least two of the plurality of grid electrodes. The electron gun includes a conductive section that hides the insulating support member to prevent the insulating support member from being directly viewed from an electron through path of the electrons emitted from the electron emitting portion and passing through the grid electrodes.

An X-ray generating tube according to a second aspect of the present disclosure includes a target and an electron gun. The target is configured to generate X rays under electronic irradiation. The electron gun includes an electron emitting portion that emits electrons, a plurality of grid electrodes that form an electron beam to be emitted toward the target, and an insulating support member that electrically insulates and supports at least two of the plurality of grid electrodes. The plurality of grid electrodes define an electron through path through which the electrons emitted from the electron emitting portion are passed. The electron gun includes a conductive section that hides the insulating support member to prevent the insulating support member from being directly viewed from the electron through path of the electrons passing through the grid electrodes.

Advantageous Effects of Invention

According to an embodiment of the present disclosure, since an electron gun of an X-ray generating tube includes a conductive section that hides an insulating support member so that the insulating support member is not directly viewed from an electron through path, an X-ray generating tube and an X-ray generating apparatus having high reliability can be provided in which fluctuations in the position or shape of the focus are reduced.

Further features of the present disclosure will become apparent from the following description of exemplary embodiments with reference to the attached drawings.

DESCRIPTION OF EMBODIMENTS

Embodiments of the present disclosure will be described in detail hereinbelow with reference to the drawings. It is to be understood that the sizes, materials, shapes, and relative dispositions of components described in the embodiments are not intended to limit the scope of the present disclosure. Known techniques of this technical field are applied to components or parts that are not particularly illustrated or described in this specification.

X-ray Generating Tube

Figure 1:
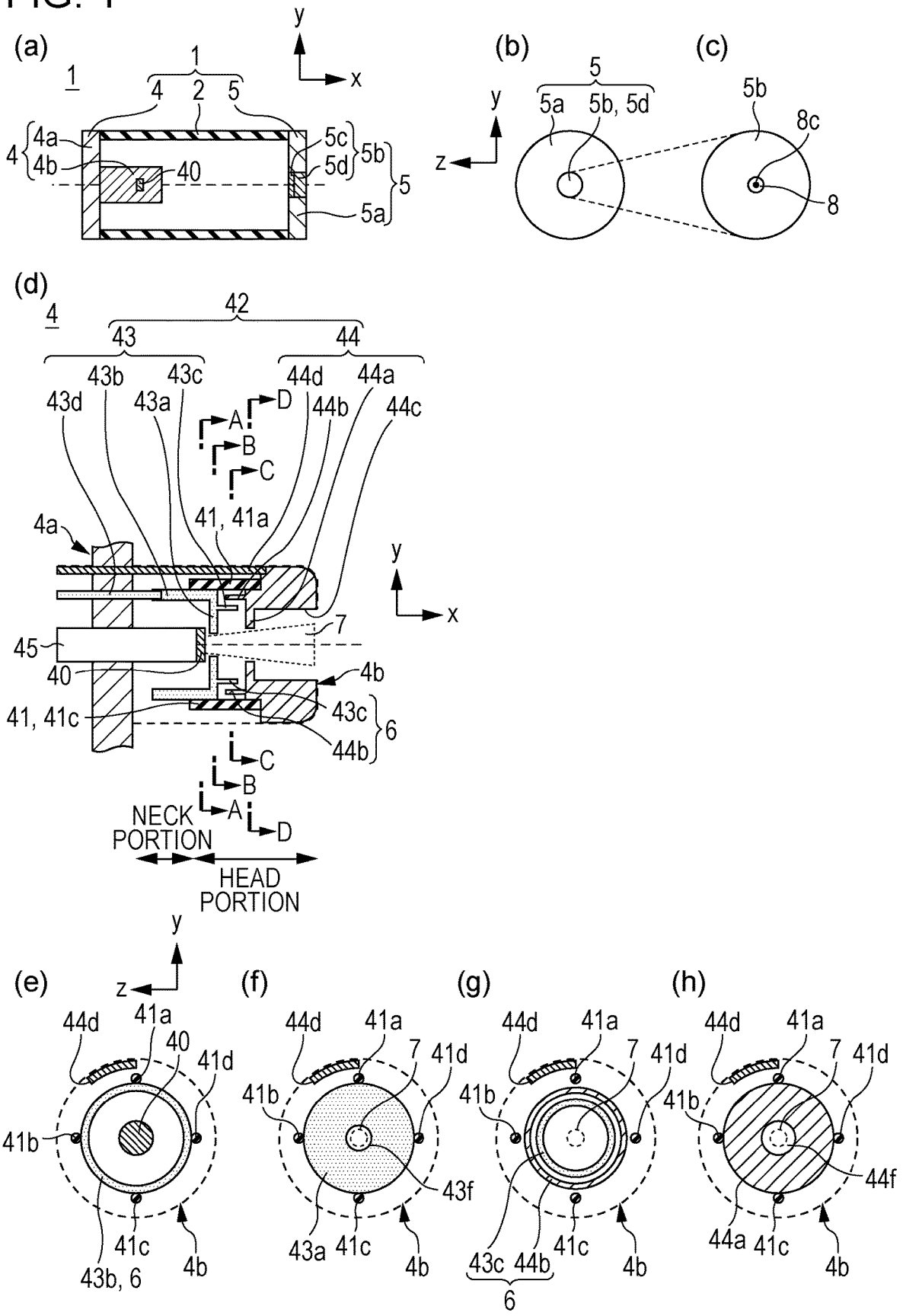
FIGS. 1(*a*) to 1(*h*) are diagrams illustrating the configuration of an X-ray generating tube according to a first embodiment of the present disclosure.

FIGS. 1(*a*) to 1(*h*) illustrate an X-ray generating tube 1 according to a first embodiment of the present disclosure. The X-ray generating tube 1 is a transmission-type X-ray generating tube including a conductive section, which is an essential feature of the present disclosure.

FIGS. 1(*a*) and 1(*b*) are two-view drawings illustrating the basic configuration of the X-ray generating tube 1. FIG. 1(*b*) is a front view of the X-ray generating tube 1 in FIG. 1(*a*) viewed from an anode 5. FIG. 1(*c*) is a partial enlarged view of FIG. 1(*b*) illustrating a focus formed on a target when the X-ray generating tube 1 according to this embodiment is driven. FIG. 1(*d*) is an enlarged cross-sectional view of an electron gun 4*b* of the X-ray generating tube 1 illustrated in FIG. 1(*a*). FIGS. 1(*e*) to 1(*h*) are cross-sectional views of the electron gun 4*b* taken along virtual planes A-A, B-B, C-C, and D-D in FIG. 1(*d*), respectively.

In this embodiment, an electron beam emitted from an electron emitting portion 40 is applied to a target layer 5*c* to cause a target 5*b* to generate X rays. For that purpose, the target layer 5*c* is disposed on a surface of the support substrate 5*d* facing the electron gun 4*b*. In other words, the electron emitting portion 40 is disposed on a cathode 4 so as to oppose the target 5*b*. Electrons emitted from the electron emitting portion 40 are accelerated to incident energy necessary for generating X rays in the target layer 5*c* by an accelerating electric field formed between the cathode 4 and the anode 5 due to a tube voltage applied to the X-ray generating tube 1.

The anode 5 includes the target 5*b* and an anode member 5*a* connected to the target 5*b* and functions as an electrode that determines the anode potential of the X-ray generating tube 1.

The anode member 5*a* is made of a conductive material and is electrically connected to the target layer 5*c*. The anode member 5*a* is connected to the periphery of the support substrate 5*d* to hold the target 5*b*, as illustrated in FIG. 1(*a*).

The target layer 5*c* contains target metal, such as tantalum, molybdenum, or tungsten, as a metallic element with a high atomic number, a high melting point, and a high specific gravity. The support substrate 5*d* may be made of a material having high X-ray transmissivity and high thermal conductivity, for example, diamond, silicon nitride, silicon carbide, aluminum nitride, graphite, and beryllium. In particular, diamond may be used as a support substrate material for a transmission-type target because it has high thermal conductivity due to sp3 bond and high radiation transmissivity.

The interior of the X-ray generating tube 1 is under vacuum to ensure an average free path of electron beams. The degree of vacuum of the X-ray generating tube 1 is preferably $1\times10^{-4}$ Pa or less and is more preferably $1\times10^{-6}$ Pa or less from the point of view of the stability of the electron emission characteristic of the electron emitting portion 40. In this embodiment, the electron emitting portion 40 and the target layer 5*c* are disposed in the internal space or on the inner surface of the X-ray generating tube 1.

The vacuum in the X-ray generating tube 1 is formed by evacuating air using an exhaust pipe and a vacuum pump (not shown) and then sealing the exhaust pipe. The interior of the X-ray generating tube 1 is sometimes provided with a getter (not shown) for the purpose of maintaining the degree of vacuum.

The X-ray generating tube 1 includes an insulating tube 2 between the anode member 5*a* and the cathode member 4*a* for the purpose of electrical insulation between the electron emitting portion 40 set at cathode potential and the target layer 5*c* set at anode potential. In other words, the insulating tube 2 is connected to the anode member 5*a* and the cathode member 4*a* at one end and the other end in the tube axis direction.

The insulating tube 2 is formed with an insulating material, such as a glass material or a ceramic material. The outer circumference of the insulating tube 2 made of ceramic is protected by a glass layer with a thickness of 0.1 μm to 100 μm to provide sufficient strength.

In this embodiment, the insulating tube 2, the cathode 4 including the electron emitting portion 40, and the anode 5 including the target 5*b* constitute an envelope having air tightness for maintaining the vacuum and robustness against atmospheric pressure. Thus, the cathode 4 and the anode 5 are connected to opposite ends of the insulating tube 2 in the tube axis direction to constitute part of the envelope. Likewise, the support substrate 5*d* functions as a transmission window through which X rays generated at the target layer 5*c* are extracted outside the X-ray generating tube 1 and constitutes part of the envelope.

Electron Gun

Next, an electron gun, which is a feature of the X-ray generating tube according to an embodiment of the present disclosure, will be described with reference to FIGS. 1(*a*), 1(*d*), and 1(*e*) to 1(*h*).

The cathode 4 includes a cathode member 4*a* and an electron gun 4*b* including the electron emitting portion 40, a grid electrode 42, and an insulating support member 41 that supports the grid electrode 42. The target 5*b* and the electron emitting portion 40 are opposed to each other.

Examples of the electron emitting portion 40 include hot-cathode electron sources, such as a tungsten filament, an impregnated cathode, and an oxide cathode, and a cold-cathode electron source, such as a spindt cathode made of molybdenum.

The electron gun 4*b* of this embodiment projects from the cathode member 4*a* toward the anode 5, as illustrated in FIG. 1(*a*). The disposition in which the electron gun 4*b* projects toward the anode 5 is intended to ensure sufficient accuracy of focal position without decreasing dielectric voltage. In other words, setting the creepage distance of the insulating tube 2 connecting the cathode 4 and the anode 5 to a predetermined distance or longer and setting the distance between the electron gun 4*b* and the target 5*b* to a predetermined distance or less reduce influence of an electrical field in the tube radius direction on an electron beam emitted from the electron emitting portion 40.

The electron emitting portion 40 and the grid electrode 42 are disposed at a portion of the electron gun 4*b* projecting toward the anode 5. This portion is referred to as a head portion. A portion that supports the head portion with respect to the cathode member 4*a* is referred to as a neck portion. As illustrated in FIGS. 1(*d*) to 1(*h*), the neck portion of this embodiment includes a cathode supporting unit 45 that supports the electron emitting portion 40, a power feeding unit 43*d* that feeds an extraction potential to an extraction grid electrode 43, and a power feeding unit 44*d* that feeds a focusing potential to a focusing grid electrode 44.

As illustrated in FIGS. 1(*d*) to 1(*h*), the electron gun 4*b* includes an extraction grid electrode 43 having an electron through hole 43*f* and a focusing grid electrode 44 having an electron through hole 44*f* and an insulating support member 41 that supports the extraction grid electrode 43 and the focusing grid electrode 44. The electron through holes 43*f* and 44*f* of the extraction grid electrode 43 and the focusing grid electrode 44 define an electron through path 7 from the electron emitting portion 40 toward the target 5*b*.

Both of the extraction grid electrode 43 and the focusing grid electrode 44 are similar in controlling the motion of electrons passing through the electron through path 7 and defining the diameter of the electron beam and are therefore collectively referred to as a grid electrode 42 in the present disclosure. The extraction grid electrode 43 is provided to chronologically control the amount of electrons emitted from the electron emitting portion 40 passing through the electron through hole 43*f*, to which a plurality of potentials are selectively applied from a voltage source (not shown). The focusing grid electrode 44 is provided to form a focusing electrical field for electrons to define the size of a focus 8 formed on the target 5*b*, to which a focusing grid potential having a predetermined potential difference from the electron emitting portion 40 is applied from a voltage source (not shown).

The electron through path 7 in this specification corresponds to a pathway through which electrons emitted from the electron emitting portion 40 pass through the focusing grid electrode 44. The electron through path 7 includes pathways of electrons passing through the grid electrode 42 (43 and 44).

The extraction grid electrode 43 has a circular portion 43*a* having an electron through hole 43*f* and extending in the radial direction and the circumferential direction. The extraction grid electrode 43 is supported at the outer rim of the circular portion 43*a* by four insulating support members 41*a* to 41*d* disposed at intervals of 90° around the electron through path 7.

The coefficient of linear expansion of the insulating support members 41*a* to 41*d* and the grid electrode 42 are matched to each other to reduce thermal stress at the connection to the grid electrode 42. If the grid electrode 42 is made of molybdenum ($\alpha$=4.8×10$^{-6}$K$^{-1}$ at 300 K), the insulating support members 41*a* to 41*d* are made of alumina ($\alpha$=7.0×10−$^{6}$K$^{-1}$ at 300 K) 3. The grid electrode 42 and the insulating support members 41*a* to 41*d* are joined together with a brazing filler (not shown).

In some embodiments, a plurality of extraction grid electrodes 43 and a plurality of focusing grid electrodes 44 are disposed (not shown). Thus, in some embodiments, three or more grid electrodes 42 are disposed (not shown). In such a configuration, the insulating support member 41 electrically insulates and supports at least two of the plurality of grid electrodes 42.

As illustrated in FIGS. 1(*d*) and 1(*h*), the focusing grid electrode 44 has a circular portion 44*a* having the electron through hole 44*f* through which electrons that have passed though the electron through hole 43*f* of the extraction grid electrode 43 can pass and extending in the radial direction and the circumferential direction.

The circular portions 43*a* and 44*a* do not need to be parallel to the radial direction (y-z plane). It is only required that the circular portions 43*a* and 44*a* have such a shape as to form an electrical field that defines the electron through path 7, for example, a cone shape. The circular portions 43*a* and 44*a* may have a discontinuous shape, such as a mesh, spiral shape, or a multi-circular shape.

First Embodiment

Next, the X-ray generating tube 1 according to the first embodiment including a conductive section, which is a feature of the present disclosure, will be described in more detail with reference to FIGS. 1(*a*) to 1(*h*).

The grid electrode 42 of this embodiment includes the extraction grid electrode 43 near the electron emitting portion 40 and includes the focusing grid electrode 44 far from the electron emitting portion 40. The extraction grid electrode 43 includes tubular portions 43*b* and 43*c* extending along the tube axis. In other words, the tubular portions 43*b* and 43*c* extend in a direction intersecting the tube radius direction. The tubular portions 43*b* and 43*c* are tubular projections projecting from the circular portion 43*a* toward the electron emitting portion 40 and the focusing grid electrode 44, respectively. The tubular portions 43*b* and 43*c* are part of the extraction grid electrode 43 and are electrically connected to a voltage source (not shown) together with the circular portion 43*a* and are regulated in potential.

The focusing grid electrode 44 is supported at the outer rim of the circular portion 44*a* by the four insulating support members 41*a* to 41*d* disposed at intervals of 90° around the electron through path 7. The circular portion 44*a* is opposed to the target 5*b*.

The focusing grid electrode 44 of this embodiment includes tubular portions 44*b* and 44*c* extending along the tube axis. In other words, the tubular portions 44*b* and 44*c* extend in a direction intersecting the radial direction. The tubular portions 44*b* and 44*c* are tubular projections projecting toward the electron emitting portion 40 and the anode 5, respectively. The tubular portions 44*b* and 44*c* are part of the focusing grid electrode 44 and are electrically connected to a voltage source (not shown) together with the circular portion 44*a* and are regulated in potential.

As illustrated in FIGS. 1(*d*) and 1(*e*), the tubular portion 43*b* projects toward the cathode member 4*a* so that the insulating support member 41 is not directly viewed from the electron through path 7. The tubular portion 43*b* is spaced apart from the electron emitting portion 40 in the radial direction to prevent the extraction grid electrode 43 and the electron emitting portion 40 from short circuit.

The tubular portion 43*c* and the tubular portion 44*b* project in opposite directions in the tube axis direction in such a manner as to overlap in the tube axis direction so that the insulating support member 41 is not directly viewed from the electron through path 7, as illustrated in FIGS. 1(*d*) and 1(*g*). In other words, the circular portion 44*a* and the circular portion 43*a*, and the tubular portion 43*c* and the tubular portion 44*b* are spaced apart to prevent the grid electrode 42 (43 and 44) from short circuit. "Overlap in the tube axis direction" means that the tubular portion 43*c* and the tubular portion 44*b* overlap so that at least part of one hides part of the other when viewed from the radial direction. The tubular portion 43*c* and the tubular portion 44*b* extend in the tube axis direction (the x-direction).

The extraction grid electrode 43 and the focusing grid electrode 44 are a pair of grid electrodes 42 whose circular portions 43*a* and 44*a* face in the tube axis direction and whose tubular portions 43*c* and 44*b* face in the tube radius direction, as illustrated in FIGS. 1(*d*) and 1(*g*). The presence of the circular portions 43*a* and 44*a* (a conductive section 6) reduces or eliminates deposition of scattered metal particles moving in the tube radius direction onto the insulating support members 41*a* to 41*d* of the electron gun 4*b* of this embodiment.

The tubular portion 43*c* is located inside the tubular portion 44*b* in the tube radius direction. In other words, the tubular portion 43*c* of the extraction grid electrode 43 whose circular portion 43*a* is located near the electron emitting portion 40 is located more inside in the tube radius direction than the tubular portion 44*b* of the focusing grid electrode 44 whose circular portion 44*a* is located far from the electron emitting portion 40.

The conductive section 6 (the tubular portions 43*b*, 43*c*, and 44*b*) plays a role in preventing metal particles scattered through the electron through path 7 from depositing on the insulating support member 41 to maintain the insulating performance of the insulating support member 41. This allows the electron emitting portion 40 and the grid electrode 42 (43 and 44) to be regulated at their respective predetermined potentials with stability. This allows the X-ray generating tube 1 of this embodiment to reduce in fluctuations in the size, position, and shape of the focus 8 due to the operation history, thus offering high reliability.

The conductive section 6 (the tubular portions 43*b*, 43*c*, and 44*b*) of this embodiment is part of the grid electrode 42 (43 and 44) and has electrical conductivity. For that reason, deposition of metal particles on the conductive section 6 (the tubular portions 43*b*, 43*c*, and 44*b*) in a range in which the adjacent electron emitting portion 40 and the grid electrode 42 (43 and 44) are not short-circuited will not cause fluctuations in the electric-field regulating operation of the grid electrode 42.

With the X-ray generating tube 1 of this embodiment, the electron gun 4*b* has the conductive section 6 (the tubular portions 43*b*, 43*c*, and 44*b*) that hides the insulating support member 41 so that it is not directly viewed from the electron through path 7, This ensures the insulating performance of the insulating support member 41. The presence of the electron gun 4*b* including the conductive section 6 (the tubular portions 43*b* and 43*c*, 44*b*) allows providing the reliable X-ray generating tube 1 in which fluctuations in the size, position, and shape of the focus 8 are reduced or eliminated.

In this embodiment, the conductive section 6 (the tubular portions 43*b*, 43*c*, and 44*b*) is part of the grid electrode 42 (43 and 44). In some embodiments, the grid electrode 42 (43 and 44) has a configuration in which electrically separated metal materials are disposed. To prevent a short circuit between the conductive section 6 and the grid electrode 42 or a short circuit between the conductive section 6 and the electron emitting portion 40 in a space in which the grid electrode 42 (43 and 44) is disposed, the conductive section 6 may be part of the grid electrode 42, as in this embodiment.

In this embodiment, the conductive section 6 (the tubular portions 43*b*, 43*c*, and 44*b*) is tubular in shape so as to hide the insulating support members 41*a* to 41*d* so that they are not directly viewed from the electron through path 7, as illustrated in FIGS. 1(*e*) and 1(*g*). However, the conductive section 6 may not necessarily be tubular in shape. In some embodiments, conductive sections are disposed separately in the circumferential direction (not shown) in correspondence with the insulating support members 41*a* to 41*d* that are separately disposed in the circumferential direction.

A mechanism in which metal particles are scattered from the electron through path 7 onto the insulating support members 41*a* to 41*d* will be described later.

Reference Embodiment

The inventor has observed fluctuations in focus diameter with the operation history of the X-ray generating tube including an electron gun having grid electrodes supported by an insulating support member.

Figure 2:
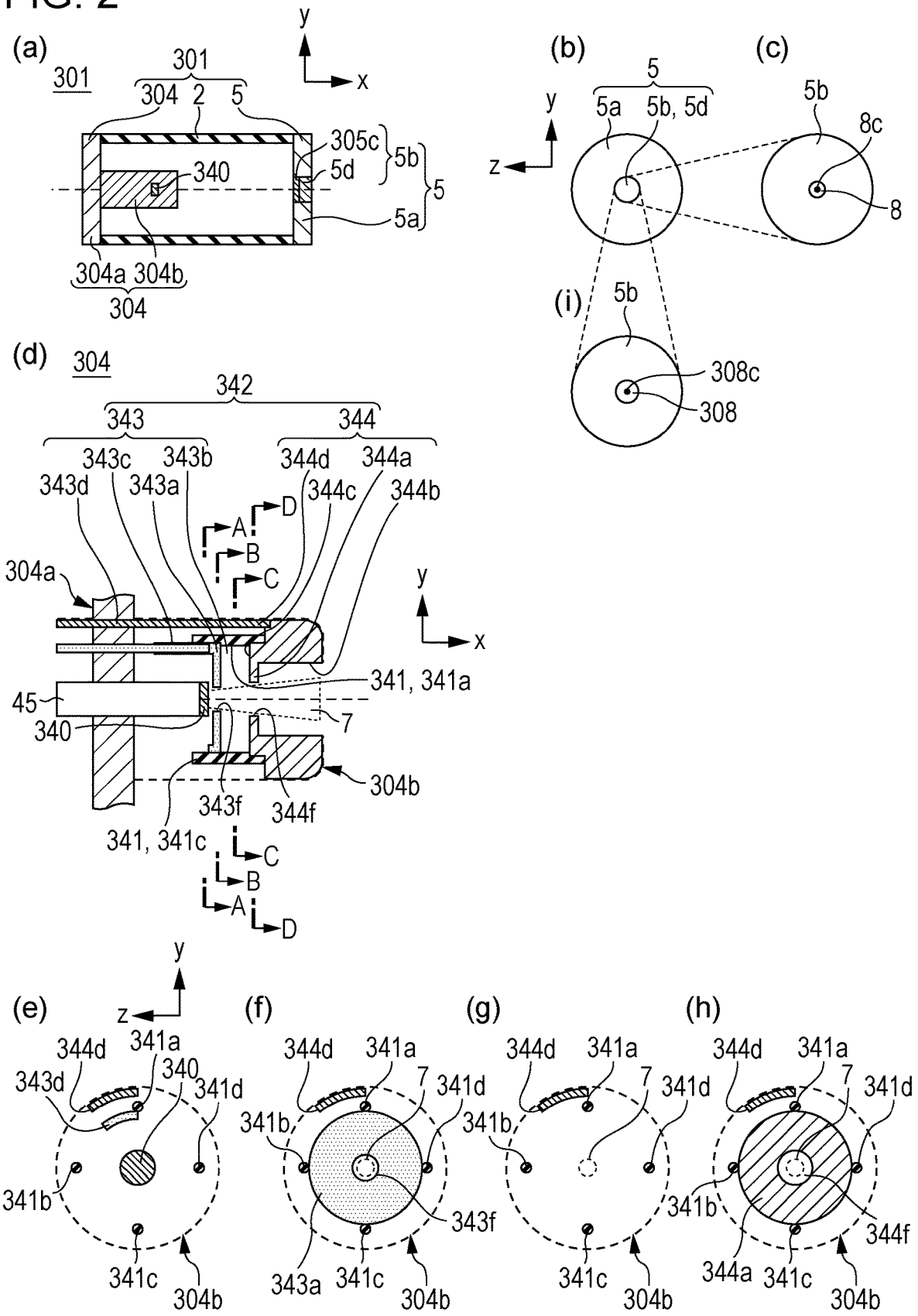
FIGS. 2(*a*) to 2(*i*) are diagrams illustrating the configuration of an X-ray generating tube according to a reference embodiment.

FIGS. 2(*a*) to 2(*e*) illustrate an X-ray generating tube 301 according to a reference embodiment different form the first embodiment in that the grid electrodes 42 and 43 do not have a tubular portion (a conductive section).

FIGS. 2(*a*) to 2(*h*) are illustrated in correspondence with FIGS. 1(*a*) to 1(*h*) according to the first embodiment. FIG. 2(*i*) schematically illustrates a focus 308 observed in the X-ray generating tube 301 after $10^4$ times of emission, in which an increase in focus diameter is observed unlike the first embodiment.

From a result of assiduous study, the inventor observed the following five facts about fluctuations in focus diameter with the operational history of an X-ray generating tube including an electron gun having grid electrodes supported by an insulating support member.

Fluctuations in focus diameter are not corrected after a down period and are irreversible.

The square $R^2$ of a correlation coefficient of fluctuations in focus diameter is expressed as follows: tube voltage<emission intensity (approximately equal to) the amount of electron beam emitted<filament current from an electron emitting source.

An analysis of an electron gun of an X-ray generating tube in which significant fluctuations are observed shows decreases in internode resistance between grid electrodes and between grid electrodes and the electron gun.

An analysis of an electron gun of an X-ray generating tube in which significant fluctuations are observed shows an increase of specific metal in the surface composition of an insulating support member.

A predominant component of the metal increased in amount is barium (Ba) caused by an electron emitting portion.

From the above observations, the inventor presumes that the cause of fluctuations in focus diameter is deposition of scattered metal particles onto an insulating support member 341 associated with the operation of the X-ray generating tube.

Elementary Process of Generation of Scattered Metal Particles

Figure 3:
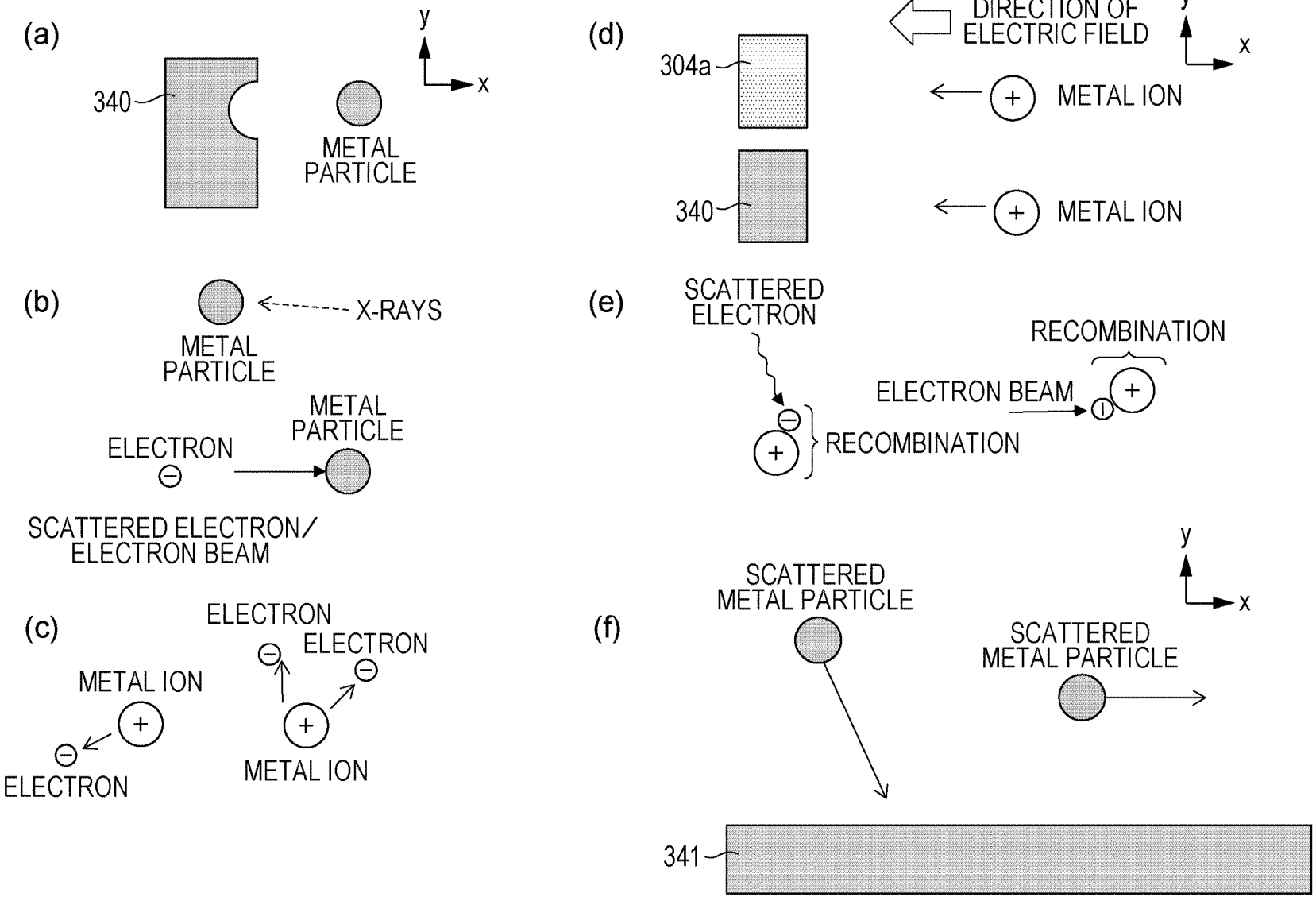
FIGS. 3(*a*) to 3(*f*) are conceptual diagrams of a presumed deposition process of scattered metal particles on an insulating support member according to an embodiment of the present disclosure.

Referring next to FIGS. 3(*a*) to 3(*f*), the elementary process of generation of scattered metal particles and their deposition on an insulating support member according to an embodiment of the present disclosure, presumed by the inventor, will be described.

The X-ray generating tube 301 contains inevitably remaining gas and floating metal particles. Such metal particles are regarded as part of the components of an electron emitting portion 340 and a target layer 305*c*, released into the vacuum space. The process for releasing the metal particles may include evaporation from the electron emitting portion 340 and spattering to the target layer 305*c* and a grid electrode 342 from the result of observation based on the exposure from the X-ray generating tube and the electron emitting operation of the electron gun, as illustrated in FIG. 3(*a*).

Since the floating metal particles have a kinetic energy of several electron volts or less, almost all of the metal particles are captured at their origin or in the vicinity thereof, while the remainder become cations under emission of electrons and irradiation with X rays, as shown in FIGS. 3(*b*) and 3(*c*).

The process of ionization of barium particles emitted from the electron emitting portion 340 will be described in (Chem. 1) and (Chem. 2) using the impregnated-type electron emitting portion 340 impregnated with barium oxide as an example.

Ba (incidence of X-ray)→$Ba^{+}$+e (Chem. 1)

Ba (incidence of +e)→$Ba^{+}$2e (Chem. 2)

The generated metal ions are moved toward the cathode 304 by electrostatic force received from an electric field in the electron gun 304*b* or the X-ray generating tube 301, as shown in FIG. 3(*d*), and the greater part of the metal ions is captured by the cathode 304. The captured metal ions seems to receive electrons on the cathode 304 and are deposited as a metal layer, as expressed as (Chem. 3).

$Ba^{+}$ e→Ba (Chem. 3)

The metal deposited on the cathode 304 can be tolerated because it has no influence on the electric-field regulating performance of the cathode member 304*a* and the electron emitting portion 340 that constitute the cathode 304.

The remainder of the metal ions recombine with scattered electrons and the electron beam before being captured by the cathode 304, as shown in FIG. 3(*e*), and receive part of the kinetic energy of the scattered electrons and the electron beam into neutral scattered metal particles.

Such scattered metal particles are not influenced by the electric field and can move in the tube radius direction (y-z plane), and are therefore fixed on the surface of the insulating support member 341 to deposit a metal layer, as illustrated in FIG. 3(*f*). As a result, the X-ray generating tube 301 including an electron gun 304*b* that has not the conductive section 6 (a tubular portion) is decreased in the electric-field regulating performance of the grid electrodes 343 and 344 with the operation history. This may result in fluctuations in focus size from the initial focus 8 shown in FIG. 2(*c*) to the defocused focus 308 shown in FIG. 2(*i*) with the operation history of the X-ray generating tube 301. In other words, the scattered metal particles are neutral scattered particles coming from metal contained in the target 5*b* or the electron emitting portion 340.

Second Embodiment

Figure 4:
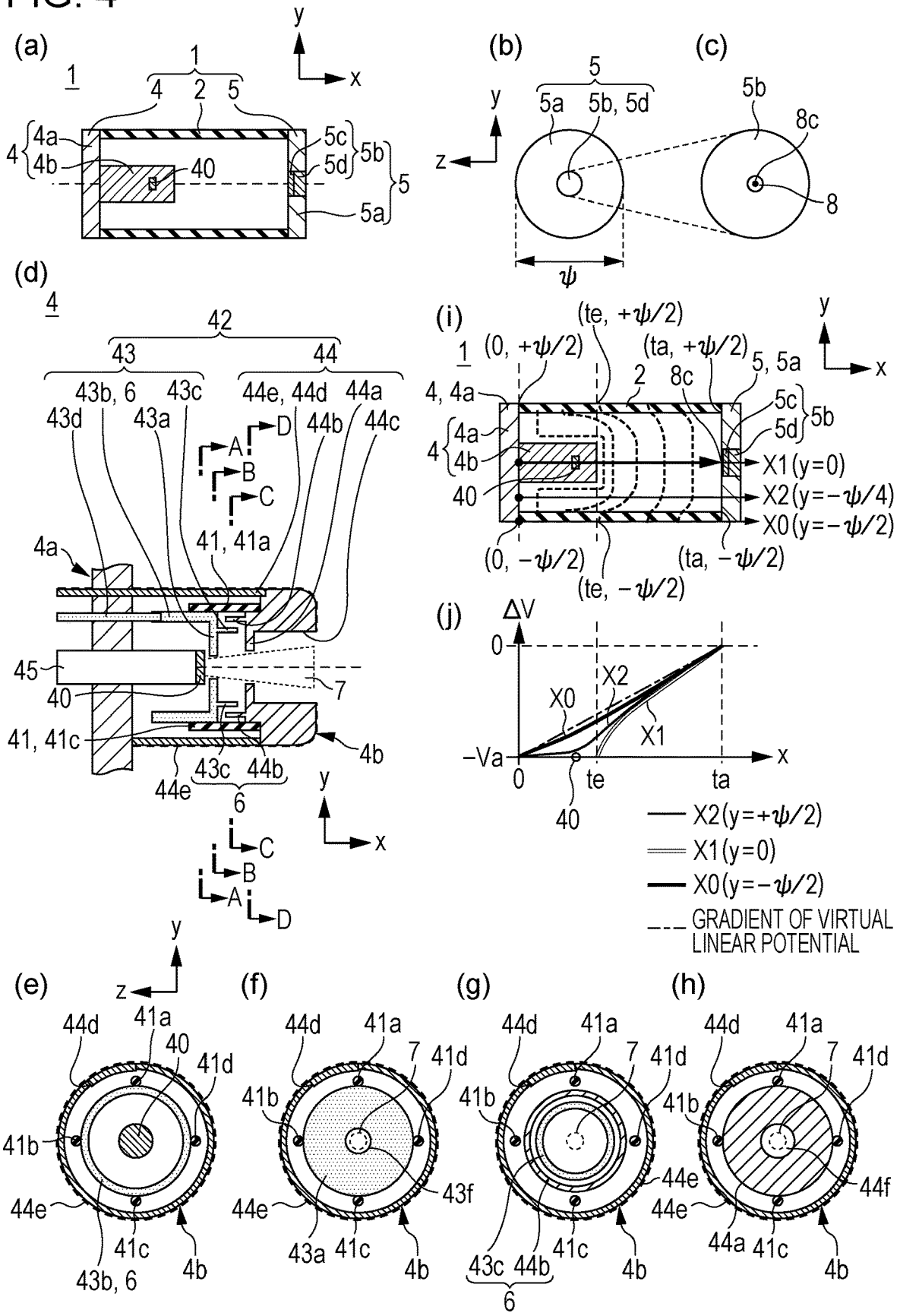
FIGS. 4(*a*) to 4(*j*) are diagrams illustrating the configuration of an X-ray generating tube according to a second embodiment of the present disclosure.

FIGS. 4(*a*) to 4(*j*) illustrate an X-ray generating tube 1 according to a second embodiment. FIGS. 4(*a*) to 4(*h*) correspond to FIGS. 1(*a*) to 1(*h*), respectively. As illustrated in FIG. 4(*d*) and FIGS. 4(*e*) to 4(*h*), this embodiment differs from the first embodiment in having a circumferential tubular portion 44*e* that hides the insulating support members 41*a* to 41*d* viewed from outside the insulating support member 41.

In this embodiment, the circumferential tubular portion 44*e* also serves as the power feeding unit 44*d* of the focusing grid electrode 44, that is, part of the focusing grid electrode 44 (the grid electrode 42).

A conductive section 6 (the tubular portions 43*b*, 43*c*, and 44*b*) located inside the electron gun 4*b* hides the insulating support members 41*a* to 41*d* as viewed from the electron through path 7. In contrast, a conductive section 6 (the tubular portion 44*e*) located outside the electron gun 4*b* hides the insulating support members 41*a* to 41*d* as viewed from an area between the electron gun 4*b* and the insulating tube 2.

Referring to FIGS. 4(*a*) to 4(*j*), technical significance that the circumferential tubular portion 44*e* provides as a conductive section will be described.

Scattered Metal Particles Coming from Backscattered Electrons

Electrons released from the electron emitting portion 40 pass through the electron through path 7 substantially at an initial velocity of 0 and are then accelerated under the electrostatic potential of a tube voltage Va onto the target 5*b* at a kinetic energy of Va (eV).

At the target 5*b*, the electrons are converted to thermal energy, secondary electrons, and Auger electrons in the target layer 5*c*, and the remainder are converted to X rays. Since the secondary electrons and Auger electrons, which interact with the target metal in the target layer 5*c* to slow down, are emitted toward the back of the target layer 5*c* only with a kinetic energy of 0 to 500 (eV), almost all of them enter the anode 5 again and are captured therein.

About 20% to 40% of the incident electrons are elastically scattered from the surface of the target layer 5*c*. The backscattered electrons elastically scattered from the surface of the target layer 5*c* have a kinetic energy of Va (eV) and therefore can reach an area on an equipotential surface of the electron emitting portion 40.

In the X-ray generating tube 1 including the electron gun 4*b* projecting from the cathode member 4*a* toward the anode 5, the electric field between the cathode 4 and the anode 5 is deformed near the cathode 4 by the electron gun 4*b*, as shown in FIG. 4(*i*).

The backscattered electrons elastically scattered from the target layer 5*c* have a scattering angle distribution, in which not only components scattered toward the electron gun 4*b* but also components that reach the space between the electron gun 4*b* and the insulating tube 2 are present.

FIG. 4(*i*) illustrates tube axis directions X0 (y=−ψ/2), X1 (y=0), and X2 (y=−ψ/4), which have different Y-coordinates in the tube radius direction. FIG. 4(*j*) illustrates potential distributions along tube axis directions X0 (y=−W/2), X1 (y=0), and X2 (y=−ψ/4) in phantom lines, where ψ(m) is the diameter of the anode member 5*a*.

Since the electrostatic potential of the electron emitting portion 40 is expressed as:

cathode potential—Va (eV), backscattered electrons that move along X2 (y=−ψ/4) reach the cathode member 4*a* from the electron emitting portion 40.

Therefore, the backscattered electrons that reach the space between the electron gun 4*b* and the insulating tube 2 recombine with a trace quantity of metal (positive) ions contained in the internal space of the X-ray generating tube 1 to change to neutral scattered metal particles. In other words, the backscattered electrons that have reached the space between the electron gun 4*b* and the insulating tube 2 seem to cause scattered metal particles to be generated in the space between the electron gun 4*b* and the insulating tube 2 to deposit on the insulating support member 41.

The circumferential tubular portion 44*e* (the conductive section) of this embodiment prevents scattered metal particles generated in the space between the electron gun 4*b* and the insulating tube 2 from depositing on the insulating support members 41*a* to 41*d* to reduce the resistance of the insulating support member 41. Thus, the electron emitting portion 40 and the grid electrode 42 (43 and 44) are regulated at their respective predetermined potentials with stability. This allows the X-ray generating tube 1 according to this embodiment to be further reduced in fluctuations in the size, position, and shape of the focus 8 with the operation history, as shown in FIG. 4(*c*), thereby having high reliability.

In other words, the circumferential tubular portion 44*e* serves as a conductive section provided outside the insulating support members 41*a* to 41*d* to prevent scattered metal particles from depositing on the insulating support members 41*a* to 41*d* from outside the tube radius direction.

The X-ray generating tubes 1 according to the first and second embodiments are transmission-type X-ray generating tubes including a transmission-type target. In some embodiments, a reflection-type X-ray generating tube including a reflection-type target is used in an X-ray generating tube including an electron gun in which grid electrodes are supported by an insulating support member.

Third Embodiment

Figure 5:
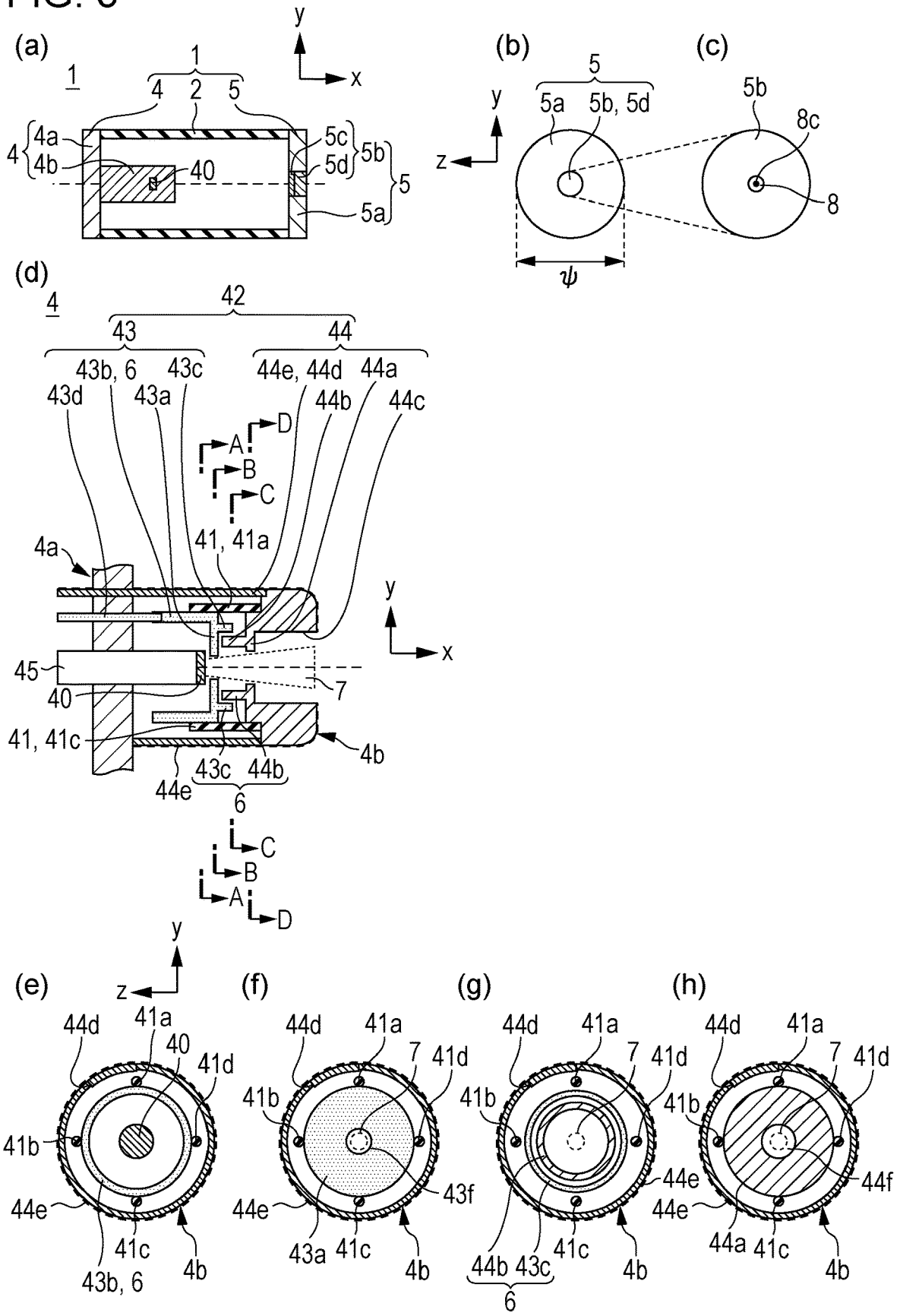
FIGS. 5(*a*) to 5(*h*) are diagrams illustrating the configuration of an X-ray generating tube according to a third embodiment of the present disclosure.

FIGS. 5(*a*) to 5(*h*) illustrate an X-ray generating tube 1 according to a third embodiment. FIGS. 5(*a*) to 5(*h*) correspond to FIGS. 1(*a*) to 1(*h*). As illustrated in FIGS. 5(*d*) and 5(*g*), this embodiment differs from the first and second embodiments in the positional relationship between the tubular portions 43*c* and 44*b* constituting the conductive section 6 in the tube radius direction. In other words, of the tubular portions 43*c* and 44*b* opposing in the tube radius direction, the tubular portion 43*c* of the extraction grid electrode 43 located near the cathode 4 is located outside, in the tube radius direction, the tubular portion 43*b* of the focusing grid electrode 44 located near to the anode 5. In other words, the tubular portion 43*c* of the extraction grid electrode 43 located near the cathode 4 is not directly viewed from the electron through path 7 because of the presence of the tubular portion 44*b* of the focusing grid electrode 44 located near the anode 5.

This disposition prevents a phenomenon in which reflected electrons (not shown) scattered backward from the circular portion 44*a* of the focusing grid electrode 44 enter the tubular portion 43*c* of the extraction grid electrode 43, reducing or eliminating fluctuations in the potential of the extraction grid electrode 43.

The X-ray generating tube 1 of this embodiment prevents not only a decrease in the insulating performance of the insulating support members 41*a* to 41*d* with the emitting operation history but also an influence of the reflected electrons incident on the grid electrode 42. This provides a further reliable X-ray generating tube in which the center 8*c* of the focus 8 is further stabilized, as illustrated in FIGS. 5(*b*) and 5(*c*).

X-ray Generating Apparatus

Figure 6:
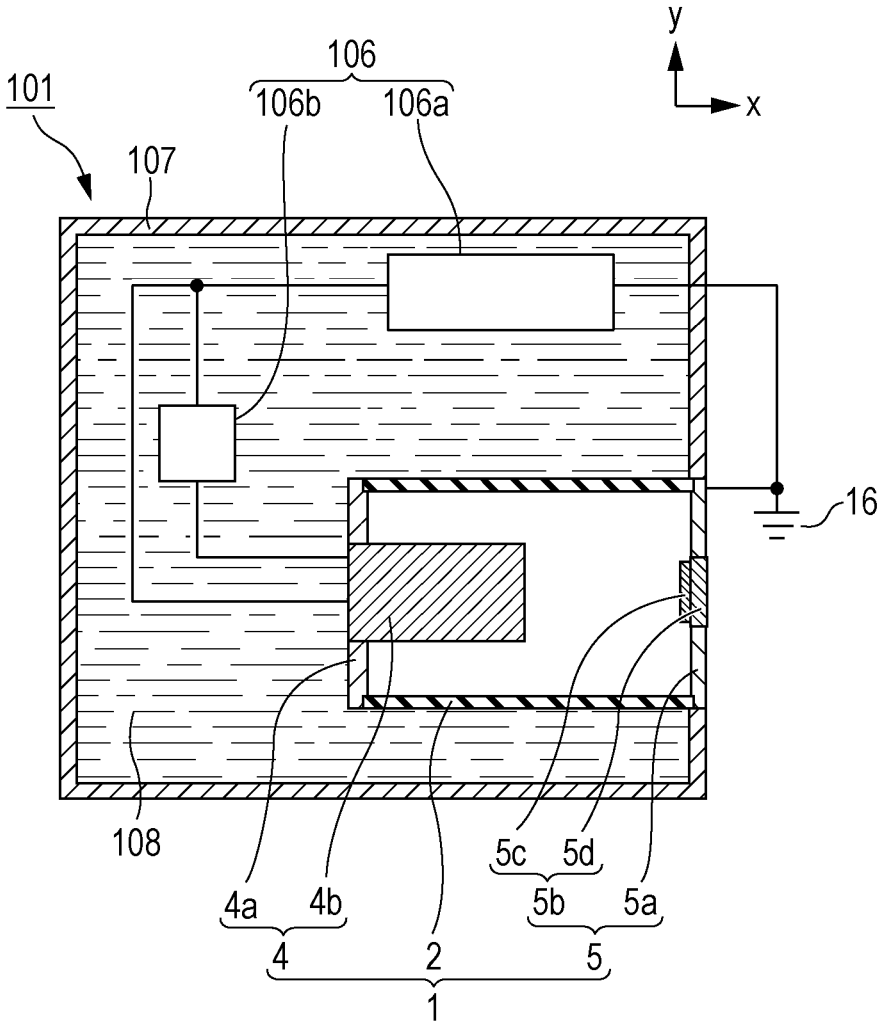
FIG. 6 is a diagram illustrating the configuration of an X-ray generating apparatus according to a fourth embodiment of the present disclosure.

Referring next to FIG. 6, an example configuration of an X-ray generating apparatus including an X-ray generating tube according to an embodiment of the present disclosure will be described.

FIG. 6 illustrates an X-ray generating apparatus 101 according to a fourth embodiment. The X-ray generating apparatus 101 includes the X-ray generating tube 1 according to the first or second embodiment, a driving circuit 106 for driving the X-ray generating tube 1, and a casing 107 that encloses the X-ray generating apparatus 101 and the driving circuit 106.

The driving circuit 106 includes a tube voltage circuit 106*a* that applies a tube voltage between the cathode and the anode and an electron-amount control circuit 106*b* that controls the amount of electrons to be emitted from the electron gun 4*b*. The tube voltage circuit 106*a* forms an accelerating electric field between the target layer 5*c* and the electron emitting portion 40. Appropriately setting the tube voltage Va according to the thickness and metal kind of the target layer 5*c* allows selection of the kind of radiation necessary for radiography.

The casing 107 of the X-ray generating tube 1 and the driving circuit 106 may have sufficient strength for the casing and high heat dissipation performance. Examples of the constituent material include metal materials, such as brass, iron, and stainless steel.

The casing 107 of this embodiment is electrically connected to the anode 5 of the X-ray generating tube 1 and is set at a grounding potential 16.

A space in the casing 107 excluding the X-ray generating tube 1 and the driving circuit 106 is filled with insulating fluid 108 to ensure electrical insulation between the casing 107 and the components in the casing 107. The components in the casing 107 include the X-ray generating tube 1, the driving circuit 106, and wiring lines (not shown).

The insulating fluid 108 is liquid having electrical insulation properties and has a function of maintaining electrical insulation in the casing 107 and a function as a cooling medium for the X-ray generating tube 1. Examples of the insulating fluid 108 include electrical insulation oil, such as mineral oil, silicone oil, and perfluoro-base oil, and insulating gas, such as sulfur hexafluoride (SF6).

Since the X-ray generating apparatus 101 of this embodiment includes at least the X-ray generating tube 1 according to one of the first 1 to third embodiments and therefore includes an electron gun in which stability of an electron beam focusing function is ensured, it has high reliability because fluctuations in the focus 8 are reduced.

Radiography System

Figure 7:
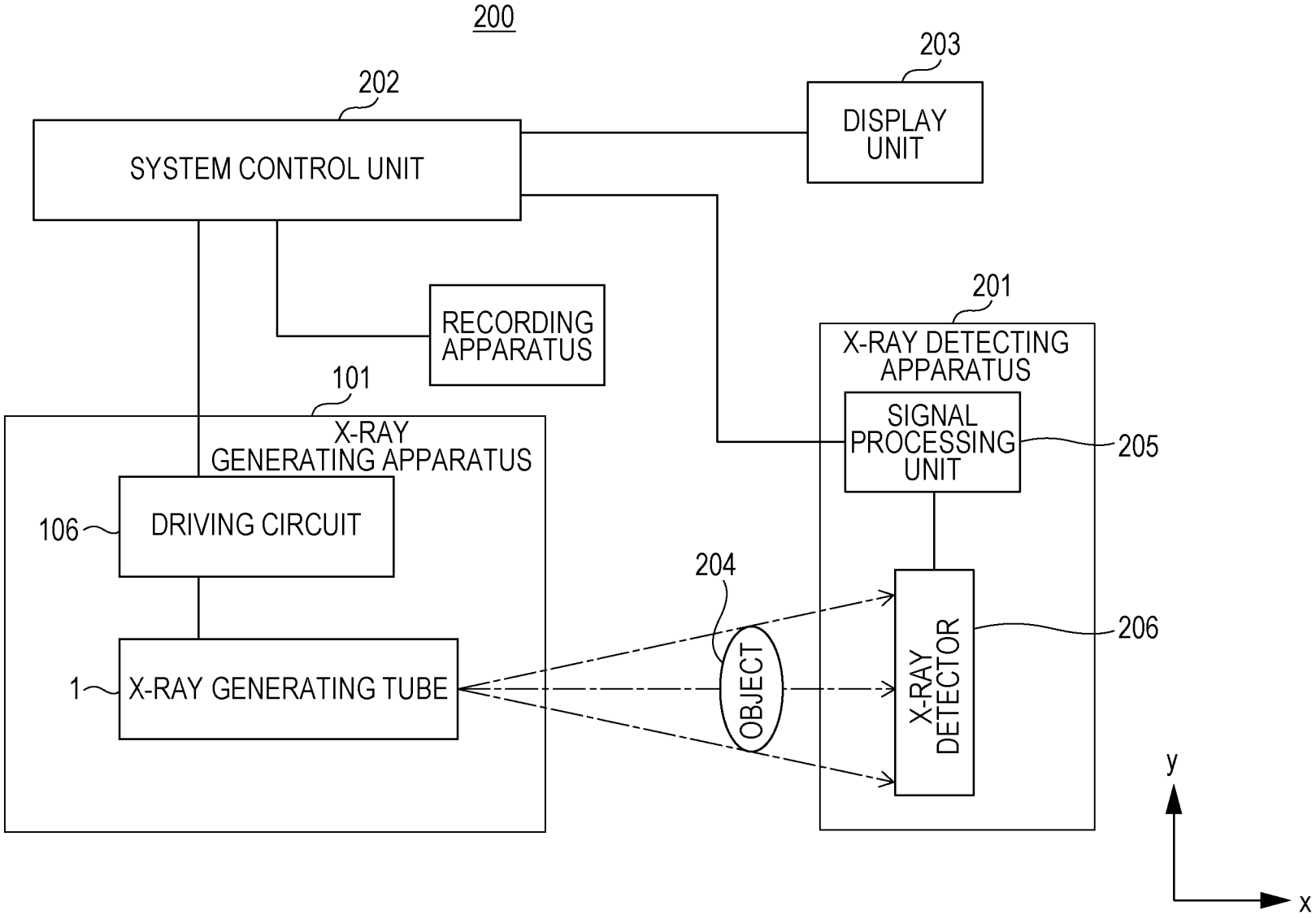
FIG. 7 is a diagram illustrating the configuration of a radiography system according to a fifth embodiment of the present disclosure.

Referring next to FIG. 7, an example configuration of a radiography system including the X-ray generating apparatus according an embodiment of the present disclosure will be described.

FIG. 7 illustrates a radiography system 200 according to a fifth embodiment. The radiography system 200 includes an X-ray detecting apparatus 201 that detects X rays generated from the X-ray generating apparatus 101 and passed through an object 204 and a system control unit 202 that controls the X-ray generating apparatus 101 and the X-ray detecting apparatus 201 in conjunction with each other.

The driving circuit 106 outputs various control signals to the X-ray generating tube 1 under the control of the system control unit 202. In response to the control signals output from the driving circuit 106, the emission state of an X-ray beam emitted from the X-ray generating apparatus 101 is controlled.

The X-ray beam emitted from the X-ray generating apparatus 101 passes through the object 204 and is detected by an X-ray detector 206. The X-ray detector 206 converts the detected X rays to an image signal and outputs the image signal to a signal processing unit 205.

The signal processing unit 205 performs predetermined signal processing on the image signal under the control of the system control unit 202 and outputs the processed image signal to the system control unit 202.

The system control unit 202 outputs a display signal for displaying an image on a display unit 203 to the display unit 203 based on the processed image signal. The display unit 203 displays an image based on the display signal on a screen as a captured image of the object 204.

Because of the presence of the X-ray generating apparatus 101 according to the fourth embodiment, the radiography system 200 of this embodiment can acquire a high-quality image with high reproductivity in which fluctuations in the focus 8 are reduced. The radiography system 200 is used for nondestructive inspection of industrial products and pathological diagnosis of human bodies and animals.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-016375, filed Jan. 29, 2016, which is hereby incorporated by reference herein in its entirety.

The invention claimed is:

1. An X-ray generating tube comprising:

an anode including an anode member and a target secured to the anode member configured to generate X rays in response to electronic irradiation;

a cathode including a cathode member;

an electron gun secured to the cathode member configured to generate electron beams toward the target; and an insulating tube secured to each one of the anode member and the cathode member and configured to electrically insulate between the anode and the cathode, wherein the electron gun includes an electron emitting portion configured to emit electrons, a plurality of grid electrodes with openings configured to define static potentials in the openings and form an electron beam passing path, and an insulating support member located outside with respect to the openings in a radius direction and configured to electrically insulate and support at least two out of the plurality of grid electrodes, wherein the insulating support member is concealed from the electron beam passing path by the plurality of grid electrodes configured not to be directly viewed from the electron beam passing through the openings.

2. The X-ray generating tube according to claim 1, wherein the grid electrodes each comprise a circular portion extending in a tube radius direction and a tubular portion connecting to the circular portion and extending in a tube axial direction, and wherein a concealed portion of the insulating support member is concealed by at least part of the tubular portion.

3. The X-ray generating tube according to claim 2, wherein the plurality of grid electrodes comprise at least a pair of grid electrodes in which the circular portions face each other in the tube axial direction and the tubular portions face each other in the tube radius direction.

4. The X-ray generating tube according to claim 3, wherein, in the pair of grid electrodes, the tubular portion of the grid electrode in which the circular portion is located near the electron emitting portion is located outside the tubular portion of the grid electrode in which the circular portion is closer to the electron emitting portion in the tube radius direction.

5. The X-ray generating tube according to claim 1, wherein the electron gun comprises a circumferential tubular portion outside the insulating support member in the tube radius direction to prevent the insulating support member from being directly viewed from outside in the tube radius direction.

6. The X-ray generating tube according to claim 1, further comprising:

an anode member connected to the target and included in an anode together with the target;

a cathode member connected to the electron gun and included in a cathode together with the electron emitting portion; and an insulating tube in which a first end and a second end in the tube axial direction are respectively connected to the anode member and the cathode member.

7. An X-ray generating apparatus comprising:

the X-ray generating tube according to claim 1; and a driving circuit electrically connected to the target and the electron emitting portion and outputting a tube voltage to be applied between the target and the electron emitting portion.

8. A radiography system comprising:

the X-ray generating apparatus according to claim 7;

an X-ray detecting apparatus configured to detect X rays emitted from the X-ray generating apparatus and passed through an object; and a system control unit configured to control the X-ray generating apparatus and the X-ray detecting apparatus in conjunction with each other.

9. The X-ray generating tube according to claim 1, wherein the insulating support member is entirely concealed along the tube axial direction by the plurality of grid electrodes.

10. The X-ray generating tube according to claim 1, wherein each two neighboring out of the plurality of grid electrodes have an overlap portion overlapping each other in the axial direction.

11. An electron gun adapted for an X-ray generating tube comprising:

an electron emitting portion configured to emit electrons;

a plurality of grid electrodes with openings configured to form an electron beam passing path; and an insulating support member located outside with respect to the openings in a radius direction and configured to electrically insulate and support proximal two out of the plurality of grid electrodes, wherein the insulating support member is concealed from the electron beam passing path by the plurality of grid electrodes configured not to be directly viewed from the electron beam passing path.

12. The electron gun according to claim 11, wherein the grid electrodes are electrically connected to the voltage source.

13. The electron gun according to claim 11, wherein the grid electrodes each comprise a circular portion extending in a tube radius direction and a tubular portion connecting to the circular portion and extending in a tube axial direction.

14. The electron gun according to claim 13, wherein the grid electrodes comprise an extraction grid electrode in which the circular portion opposes the electron emitting portion and the tubular portion is disposed so as to overlap with the electron emitting portion in the tube axial direction.

15. The electron gun according to claim 13, wherein the plurality of grid electrodes comprise at least a pair of grid electrodes in which the circular portions face each other in the tube axial direction and the tubular portions face each other in the tube radius direction.

16. The electron gun according to claim 15, wherein, in the pair of grid electrodes, the tubular portion of the grid electrode in which the circular portion is located near the electron emitting portion is located outside the tubular portion of the grid electrode in which the circular portion is located closer to the electron emitting portion in the tube radius direction.

17. The electron gun according to claim 11, further comprising a circumferential tubular portion outside the insulating support member in the tube radius direction to prevent the insulating support member from being directly viewed from outside in the tube radius direction.

18. The electron gun according to claim 17, wherein the circumferential tubular portion is part of the grid electrodes.

19. An X-ray generating tube comprising:

an anode including a target configured to generate X-rays and an anode member connected to the target;

a cathode including the electron gun according to claim 18 and a cathode member connected to the electron gun; and an insulating tube secured to each one of the anode member and the cathode member and configured to electrically insulate between the anode and the cathode.

20. An X-ray generating apparatus comprising:

the X-ray generating tube according to claim 19; and a driving circuit electrically connected to the target and the electron emitting portion and outputting a tube voltage to be applied between the target and the electron emitting portion.

21. The electron gun according to claim 11, wherein each one of the plurality of grid electrodes includes a tubular portion extending in a tube axial direction between a corresponding one of the openings and the insulating support member to prevent neutral metal particles from depositing on the insulating support member.

22. The X-ray generating tube according to claim 21, wherein the neutral metal particles come from metal contained in the electron emitting portion.

23. The electron gun according to claim 11, wherein the insulating support member is entirely concealed along the tube axial direction by the plurality of grid electrodes.

24. The electron gun according to claim 11, wherein each two neighboring out of the plurality of grid electrodes have an overlap portion overlapping each other in the axial direction.

* * * * *